United States Patent [19]

Edwards et al.

[11] 4,433,884

[45] Feb. 28, 1984

[54] WORK SURFACE SUPPORT SYSTEM

[75] Inventors: Thomas M. Edwards, Wyoming; James O. Kelley, Spring Lake; Michael D. Beard, Hudsonville, all of Mich.

[73] Assignee: Herman Miller, Inc., Zeeland, Mich.

[21] Appl. No.: 291,770

[22] Filed: Aug. 10, 1981

[51] Int. Cl.[3] ..... A47B 91/00

[52] U.S. Cl. ..... 312/256; 312/107; 312/209; 312/250; 312/265

[58] Field of Search ..... 312/107, 111, 209, 250, 312/256, 264, 265; 211/182, 186, 187, 193; 108/59, 111, 153, 155; 248/188.1

[56] References Cited

U.S. PATENT DOCUMENTS

| | | | |
|---|---|---|---|
| 1,933,932 | 11/1933 | Reinhard | 45/6 |
| 2,930,665 | 3/1960 | Budai | 312/111 |
| 3,114,531 | 12/1963 | Webe | 248/242 |
| 3,212,646 | 10/1965 | Propst | 52/36 X |
| 3,356,434 | 12/1967 | Theodores | 312/111 X |
| 3,674,230 | 7/1972 | Propst | 248/188.8 |
| 3,776,498 | 12/1973 | Peters et al. | 248/221 |
| 3,920,299 | 11/1975 | Propst et al. | 312/223 |
| 4,171,789 | 10/1979 | Van der Hoek et al. | 248/243 |

FOREIGN PATENT DOCUMENTS

| | | | |
|---|---|---|---|
| 1380172 | 8/1965 | France | 248/188.1 |
| 617468 | 2/1961 | Italy | 312/265 |
| 566555 | 7/1977 | U.S.S.R. . | |

OTHER PUBLICATIONS

Special Purpose Work Tables, 1977 Herman Miller Health Science Division Product Catalog.

Rail and Wall Attachments, 1977 Herman Miller Health Science Division Product Catalog.

*Primary Examiner*—James T. McCall

*Assistant Examiner*—Joseph Falk

*Attorney, Agent, or Firm*—Varnum, Riddering, Schmidt & Howlett

[57] ABSTRACT

A modular laboratory furniture system includes freestanding tubular frame modules (22) and freestanding table (36) arranged about a room in a preplanned configuration. The system further includes mobile carts (40) movable about the room. The frame modules (22) and tables (36) each mount a horizontal work surface (50). Pairs of spaced-apart common support means (38) mount the work surfaces (50) and also are used to construct the carts (40). The common support means (38) includes a hollow vertical leg (56, 58), a bracket member (52, 54) and means for securing one portion of the leg (56, 58) to the bracket member (52, 54). The base portion (92) of the bracket member (52, 54) has a perimeter which mates with that of the leg (56, 58). Detachably secured to the legs (56, 58) of the spaced-apart support means (38) are rails (60, 61). The rails (60, 61) support at least one storage component on the frame module (22), table (36) and carts (40). The common support means (38) allow for mounting of work surfaces (50) to the frame modules (22) and tables (36) and the construction of carts (40) using a minimum of parts and provide for versatility in making changes in the system.

18 Claims, 26 Drawing Figures

WORK SURFACE SUPPORT SYSTEM

DESCRIPTION

1. Technical Field

The invention relates to a laboratory system including work surfaces and carts constructed from a plurality of common components.

2. Background Art

Modern laboratory systems as well as other environments requiring work surfaces, tables and carts should be able to be tailored to the specific needs of the user. The user should have the ability to select the specific configuration of the laboratory equipment and also be able to change the set up as needed. Presently, lab equipment is becoming more complex and often includes various types of electronic and computer devices. Due to the rapid changes in this technology it is often necessary to remodel or revamp an existing laboratory to accomodate these changes. In order to be able to make these modifications, it is desirable that the components which make up the system be readily interchangeable and be easily disassembled and assembled into the new configurations. Further, it is desirable that a small number of interchangeable components be used to construct the various work surfaces and other components which are used in the laboratory.

One example of an existing laboratory system is shown in U.S. Pat. No. 3,920,299, issued Nov. 18, 1975, and commonly assigned with this application. U.S. Pat. No. 3,920,299 illustrates a laboratory module system wherein a plurality of frames are joined together to form a core module which support various work surfaces, storage units and the like.

In order to increase the flexibility of a laboratory system such as that shown in U.S. Pat. No. 3,920,299, it is desirable to construct the various work surfaces from common parts. In this way, the number of components used to make up the system is reduced and the same components can be reused and assembled into the desired configurations.

DISCLOSURE OF THE INVENTION

In accordance with the invention, a modular laboratory furniture system comprises freestanding tubular frame modules and tables all of which are selectively arranged about a room. The system further includes mobile carts movable about the room. The frame modules and tables mount a horizontal work surface. Each work surface is supported on the frame modules and tables by pairs of spaced apart common support means. The carts also include the common support means. Each support means includes a hollow vertical leg of rectangular configuration and a bracket member having an extension arm for mounting to an underside of the work surface or for providing a bottom support and a base portion for mounting to the vertical leg. The bracket member and one portion of the leg are mounted together so that the base portion of the bracket member mates with the cross-sectional configuration of the leg. Further, means are provided for mounting the work surfaces to the extension arms of certain of the bracket members. Supported on the frame modules, tables and carts are a variety of storage components. At least one of the storage components is mounted to rails which are detachably secured to a pair of vertical legs of a pair of the spaced-apart support means. The common support means for the work surfaces, tables and carts allows for the construction of tables, carts and hanging surfaces using a minimum of parts and allows for versatility in the system.

The bracket member is a unitary, die-cast member having parallel, spaced-apart side walls joined by perpendicular webs integrally formed with the side walls. The leg and base portion of the bracket arm have a width preferably between $\frac{1}{4}$ and $\frac{1}{3}$ of the length of the extension arm. The wide base adds to the rigidity of the arm and provides a good load capacity. The vertical leg is secured to the bracket member by threaded rods which extend internally through the two parts. The rail secured between the vertical legs is a hollow extruded member which includes a lip for mating with an attachment member on the storage components. Further, the frame modules include hanger means for releasably supporting the support means. Hanger clips are secured to the bracket members to as to mount the support means and attached work surfaces to the frame modules.

The angular orientation of the work surfaces can be adjusted by use of a levelling means. The levelling means includes means mounting the top portion of the support means to a vertical support and means for pivoting the support means and attached work surface about a horizontal axis so as to level the work surface. The pivoting means includes a block member secured stationary relative to the support means and a rod threadedly received in the support means and having an end which bears against the block. As the rod is rotated, the support means is angularly displaced relative to the block member so as to pivot the work surface about the horizontal axis.

Tables constructed in accordance with the invention are provided with base means for supporting the table on the floor. The base means comprises a bracket member used in an inverted position so that the extension arm is positioned adjacent the floor. The carts are constructed so that the bracket members are mounted to the bottom of the vertical leg. The top of the leg mounts a cap member and the cap member is secured to the leg by the same fastener which secures the bracket member and leg together. The cart includes casters which allow the cart to be rolled about the room.

The above-described common components allow for the construction and modification of a laboratory system in a simple manner. The common components are detachably secured together and are readily interchangeable so as to accomodate changes in the needs of the laboratory. Further, the components have a uniform configuration and provide a pleasing aesthetic appearance.

BRIEF DESCRIPTION OF THE DRAWINGS

The invention will be described with reference to the accompanying drawings wherein like members bear like reference numerals in which.

BEST MODE FOR CARRYING OUT THE INVENTION

Figure 1:
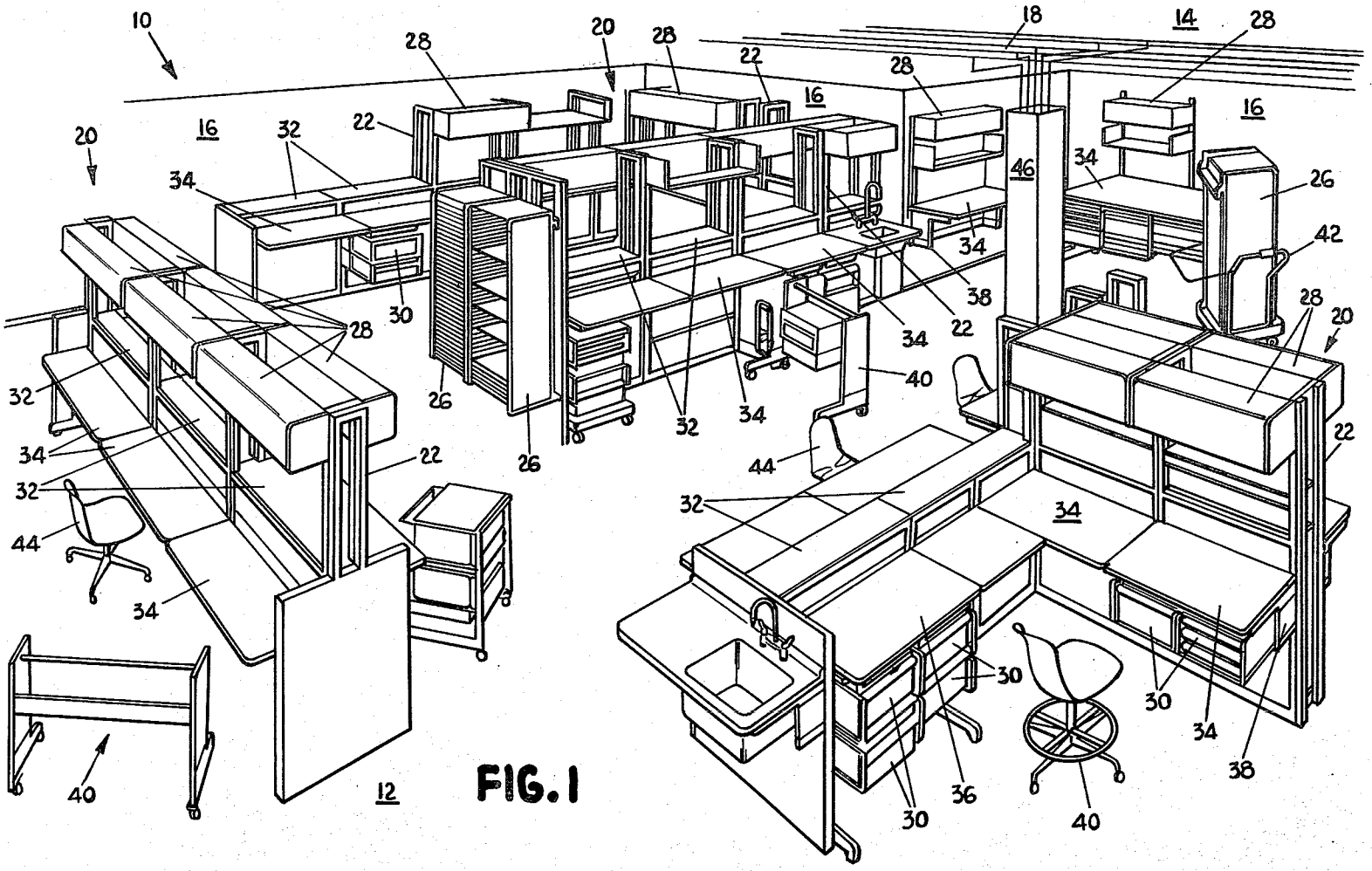
FIG. 1 is a perspective view of a modular work surface system in accordance with the invention.

With reference to FIG. 1, a laboratory system in accordance with the invention is shown as installed in a room 10. The laboratory system allows for great efficiency by providing flexibility in the arrangement of work stations in order to meet a specific need. The laboratory system includes various work surfaces, storage components, transportation carts, utility chases and seating, all of which are arranged in a selected configuration. The system is constructed of a number of common components used in the various carts, work surfaces and the like. The system allows for adaptation to changing requirements in the laboratory and the evolution of new parts, all of which can interface with the existing components. Further, the components are detachably secured together which allows for easy assembly and disassembly of the parts. The lab system is installed in a room 10 having a floor 12, ceiling 14 and walls 16. Disposed in the ceiling are utility and service lines 18 necessary for telephone, electricity, water, gas and the like. The utility and service lines can be disposed in the floor or wall in addition to or instead of the ceiling.

Selectively arranged about the room are a plurality of work stations 20. The configurations of the work stations 20 are selected to meet the particular needs of a laboratory. The work stations 20 comprise frame modules 22 which are tubular, three-dimensional rigid structures which support work surfaces, storage components and the like to be described below. The frame modules 22 are all freestanding and can be arranged in the middle of a room or adjacent a wall 16. The frame modules 22 include hanging intelligence for supporting the work surfaces, storage components and the like.

A variety of different types of storage components are used in connection with the lab system as shown in FIG. 1. The storage components include lockers 26, such as that shown in U.S. Pat. No. 3,712,697 issued Jan. 23, 1973, flipper cabinets 28 which are hung on the frame modules 22 above the work surface, drawers 30 mounted beneath the work surface and shelving 32 mounted to the frame module 22. The type and number of storage components is selected to meet the needs of the laboratory and all of the components are arranged so as not to interfere with the work areas in the laboratory.

A variety of work surfaces are also employed in connection with the laboratory. The work surfaces can be in the form of hanging surfaces 34 which are mounted to the frame modules 22 or a wall 16 in a manner to be described below and freestanding tables 36 which can be arranged adjacent a frame module 22, adjacent a wall 16 of the room, or placed in the room independently of a vertical support. Both the hanging surfaces 34 and freestanding tables 36 include support assemblies 38 which comprise one of the common elements of the system and mount the work surfaces. The configuration of the support assemblies 38 will be described in more detail with reference to FIGS. 2, 9 and 10.

Various types of carts 40 and transportation devices 42 can also be used to carry equipment and supplies through the laboratory system. The carts 40 can be used as a transportation mechanism and are constructed with the components used to construct the hanging surfaces 34 and tables 36. Transporters 42 are used to carry the lockers 26 throughout the laboratory area.

As can be seen in FIG. 1, a number of seats are arranged in the room. Further, a vertical utility chase 46 provided on at least one frame module 22 extends to the ceiling 14 to allow for the connection of the utilities and service lines 18 contained in the ceiling 14 of the room to the work stations 20. The frame modules serve as horizontal chases for connecting the utilities to the different work areas.

FIGS. 2*a* through 2*k* illustrate the common components which are used to construct the hanging surfaces 34, tables 36 and carts 40 of the above-described laboratory system. The components provide a means for assembling the various work surfaces, carts and the like which are described above and provide a simple method of building a system with a minimum of parts. By using such common parts, tooling requirements are held to a minimum. The parts are secured together in a releasable fashion which enhances the interchangeability and versatility of the components used in the system.

Figure 2A:
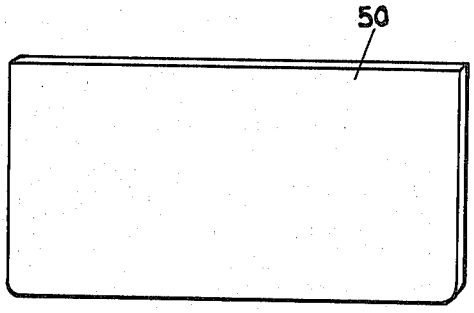
FIGS. 2*a* through 2*k* illustrate various components used to construct the system of FIG. 1.
Figure 2E:
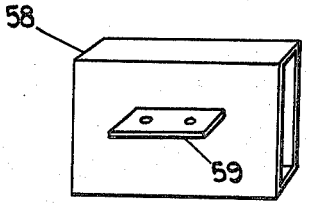
Figure 2D:
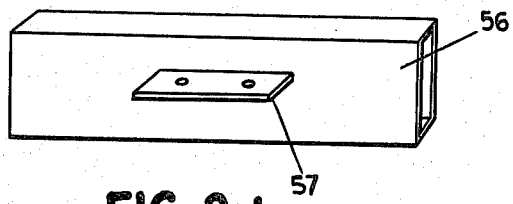
Figure 2J:
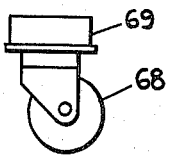
Figure 2K:
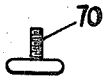
Figure 2G:
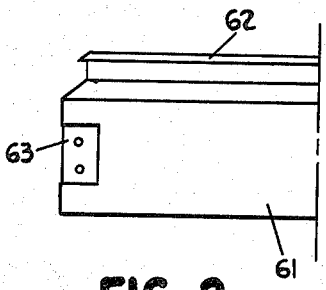
Figure 2F:
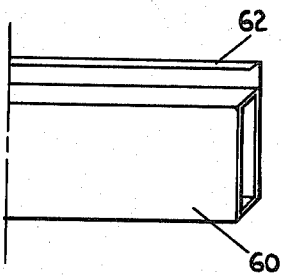
Figure 2H:
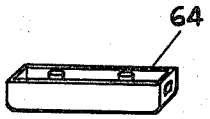

FIG. 2*a* illustrates a work surface 50 used in constructing a hanging surface 34 or a freestanding table 36 as shown in FIG. 1. The work surface 50 is mounted to the frame modules 22 or constructed into a freestanding table 36 by using support assembly 38. The work surface 50 can have a variety of sizes depending upon the particular application. Various sizes and configurations of the surfaces 50 are shown in FIG. 1. The work surfaces 50 can be provided in a range of performance levels each having differing load capacities and resistances to chemicals, heat and the like. In this way, the work surface 50 can be selected to meet the specific needs of the laboratory.

Figure 2C:
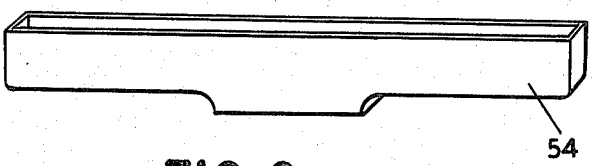
Figure 2B:
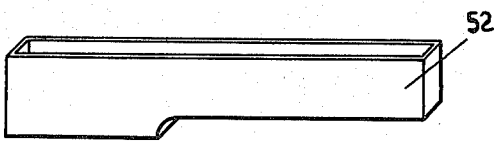
Figure 2I:
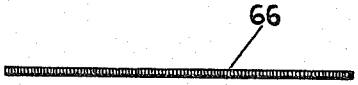

The surfaces 50 are mounted to either the frame modules 22 or constructed into a freestanding table 36 using support arms 52 or 54 (see FIGS. 2*b* and 2*c*). The support arms 52, 54 are integral, die cast parts. The support arms 52 and 54 will be described below in greater detail with reference to FIG. 9. Die casting of the parts allows for relatively easy manufacture and requires a minimum of finishing or machining. The support arms 52 and 54 are adapted to be mounted beneath the work surface 50 and to the frame modules 22 or walls 16. Support arm 52 is a single width support arm used to suspend a work surface 50 from the frame modules 22 or walls 16. The support arms 52 can also be used to construct a freestanding table 36 by using the support arms 52 as a base for the table. The support arm 52 can also be used to construct carts 40, with the arm 52 serving as a base for the cart. The double width arm 54 can be used to construct larger freestanding tables 36 with the arm 54 functioning both as a support for the work surface 50 and as a base for the table 36.

The support arms 52 and 54 are connected to leg tubes 56 and 58 (see FIGS. 2*d* and 2*e*) which also make up part of the support assembly 38 which forms part of the cart 40, freestanding table 36, and hanging work surface 34. The leg tubes 56, 58 are generally hollow extruded aluminum parts having a rectangular cross-section. The leg tubes 56, 58 preferably come in two standard lengths, an elongate tube 56 and a shorter tube 58. The elongate tube 56 is used in constructing freestanding tables 36 and carts 40 with the tubes 56 forming a portion of the leg. The shorter leg tube 58 is preferably used in constructing support brackets 38 for supporting hanging surfaces 34. The leg tubes 56, 58 can be used with either of the support brackets 52 and 54 so that the four pieces can be used interchangeably to construct a hanging surface, table or cart configuration. The leg tubes 56 and 58 include a fastening means for mounting stretcher rails 60, 61 (see FIGS. *2f* and *2g*) which support storage components, such as drawers 30, thereon. The fastening means is in the form of a rectangular bracket 57, 59 which is either welded or bolted to the leg tubes.

The stretcher rails 60, 61, as shown in FIGS. *2f* and *2g*, is a hollow elongate tubular member having a generally rectangular cross-section. The stretcher rails 60, 61 are adapted to be mounted between two leg tubes of either a freestanding work surface 36, a hanging surface 34 or a cart 40 as will be described below with reference to FIG. 3. The end portion of rail 60 used with tables 36 and carts 40 has an open cross-section (FIG. *2f*) which receives the bracket 57. The open end of the rail 60 is slid over the bracket 57 and fastened in place by screws. The end of rail 61 (FIG. *2g*) used with hanging surfaces 34 has a notched surface 63 which receives the bracket 59 in an overlapping manner. The rail 61 is secured to the bracket 59 by screws. The stretcher rails 60, 61 include a lip 62 which receives a mating projection on a storage component such as shown in U.S. Pat. No. 3,212,646, issued Oct. 19, 1965. The stretcher rails 60, 61 allow for the mounting of storage components such as drawers 30 beneath the work surface 50 or to a cart 40 without the need for hanging the storage component directly from the work surface 50 and thereby necessitating an increased load capacity for the surface 50.

When mounting a work surface 50 to a frame module 22 in a cantilevered fashion, the support assembly 38, which comprises a leg tube 58 and a support arm 52, is completed by an end cap 64 (FIG. *2h*) mounted at the bottom portion of the leg tube 58. The end cap 64 is a die cast part secured to the support assembly 38 by elongate threaded tie rods 66 (FIG. *2i*) which secure the end cap 64 to the support arm 52. The tie rods 66 pass through the leg tubes 58 but are not secured thereto. The end cap 64 is also used in constructing the carts 40.

If a freestanding table 36 is to be constructed using the above described components, the table 36 can be provided with either casters 68 or glides 70 (FIGS. *2j* and *2k*). The casters 68 or glides 70 are mounted to the base of the table which is constructed using one of the support arms 52 or 54, as will be described below. Interposed between the caster 68 and the table base is a pad 69 which mounts the caster 68 to the table base.

Figure 3:
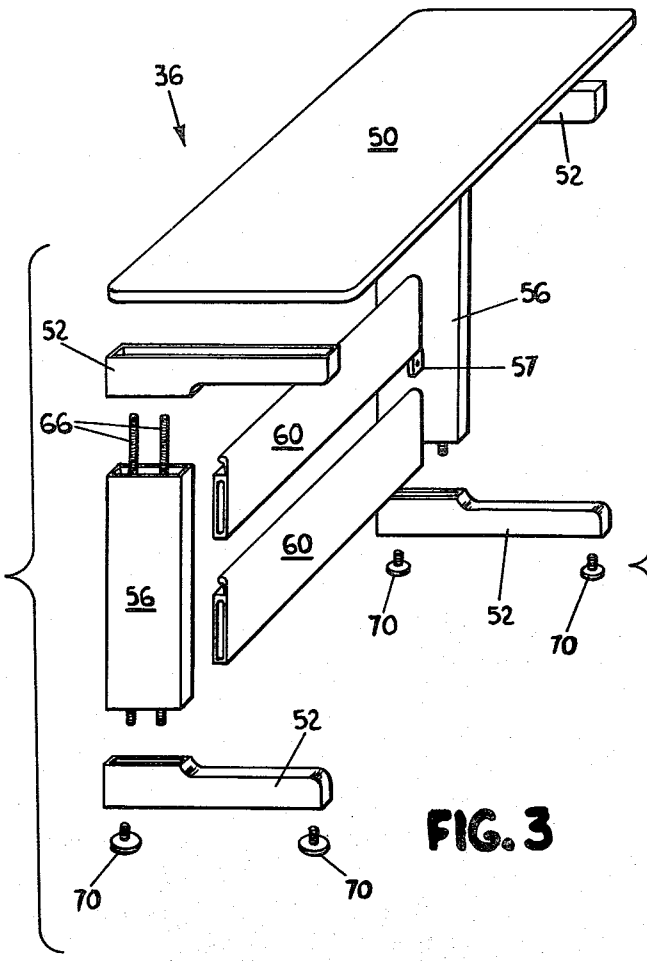
FIG. 3 is an exploded view of a table in accordance with the invention.

FIG. 3 illustrates a freestanding table 36 constructed in accordance with the invention using the above-described common components. The table 36 includes a work surface 50 supported on support arms 52. The legs of the table 36 are in the form of elongate leg tubes 56 with the base of the table being made up of inverted support arms 52. The two support arms are secured together by means of the tie rods 66. Extending between the legs of the table are stretcher rails 60 on which can be mounted hanging storage components, such as drawers 30. The rail 60 is mounted in a detachable fashion by positioning the rail 60 between the leg tubes 56 and sliding the ends of the rail 60 onto the brackets 57. The screws are then fastened to secure the rail 60 in place. No special tools other than a screw driver are needed to mount the rail 60 and the rail 60 is readily detachable so as to allow for restructuring of the system. The table 36 can be provided either with casters 68 or glides 70 to support the table on the floor.

Figure 4:
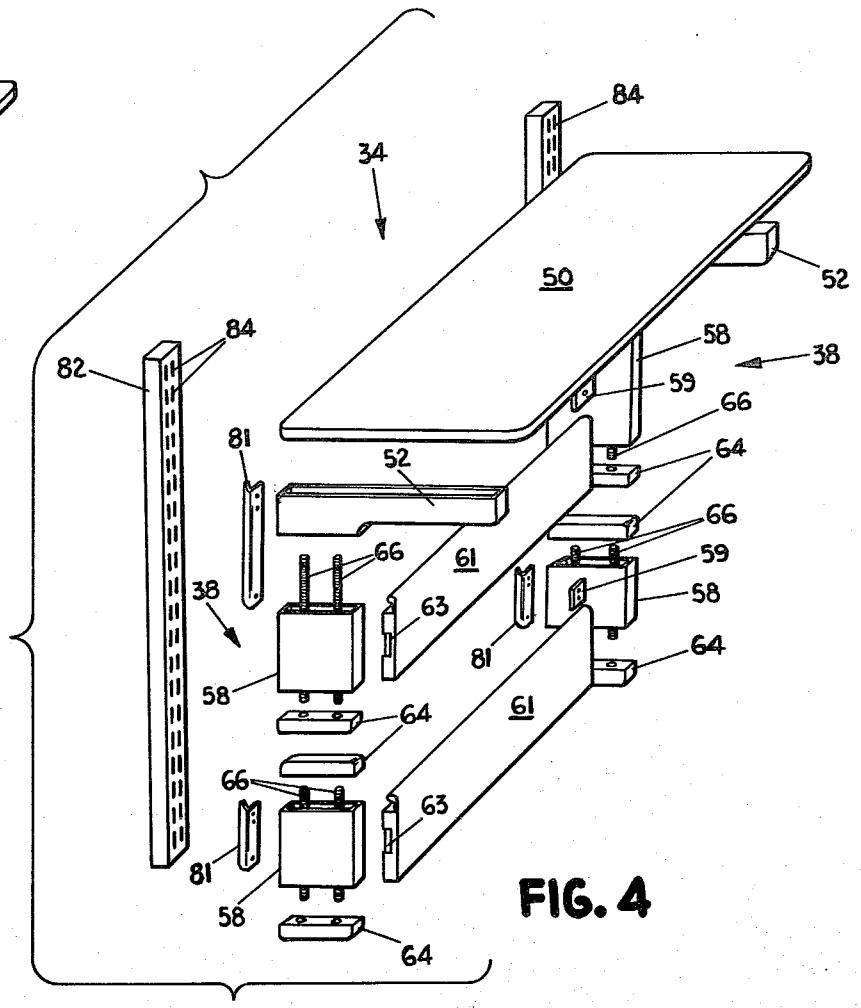
FIG. 4 is an exploded view of a hanging surface mounted to a vertical support in accordance with the invention.

FIG. 4 shows a hanging surface 34 which is mounted to a vertical wall 16 or frame module 22 as in FIG. 1. The hanging surface 34 includes a surface 50 supported on a support assembly 38 comprising arm 52, tube 58 and end caps 64 which are secured together by means of the elongate tie rod 66 as described in further detail with reference to FIG. 9. A hanger clip 81 is screwed to the back of the support assembly 38 so that the clips 81 can be received in elongate slots 84 in stiles 82 secured to the wall 16 or frame module 22. A stretcher rail 61 can be supported between the leg tubes 58 of the hanging surface 34, as described above with respect to rail 60, so as to provide for mounting of hanging storage components. In installing the rail 61, the notch in the end of rail 61 is placed adjacent bracket 59 so as to overlap the bracket 59. The rail 61 is then secured in placed with screws. The notches 63 in the ends of the rail 61 allow for the installation of the rail without dismantling the hanging surface. In this regard, the notches allow the rail 61 to be positioned without spreading the support assemblies 38 which would disturb the adjacent work surfaces. A second stretcher rail 61 can be mounted below the work surface 50 to provide additional storage capacity. The second rail is supported on leg tubes 58, in the above-described fashion, which are secured to the stiles 82 by means of clips 81. The clips 81 are attached to end caps 64 which are mounted to the leg tubes 58 by the threaded rods 66. The clips 81 are secured to the end caps 64 through screws in a manner similar to that shown in FIG. 9.

Figure 5:
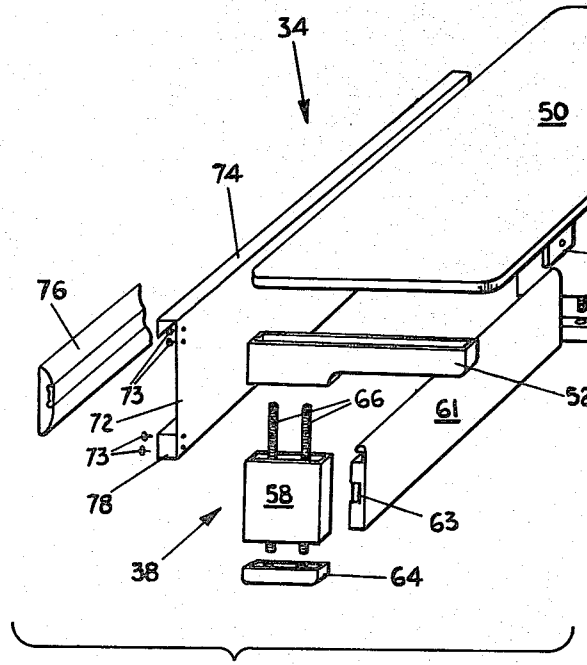
FIG. 5 is an exploded view of a rail-hung surface in accordance with the invention.
Figure 9:
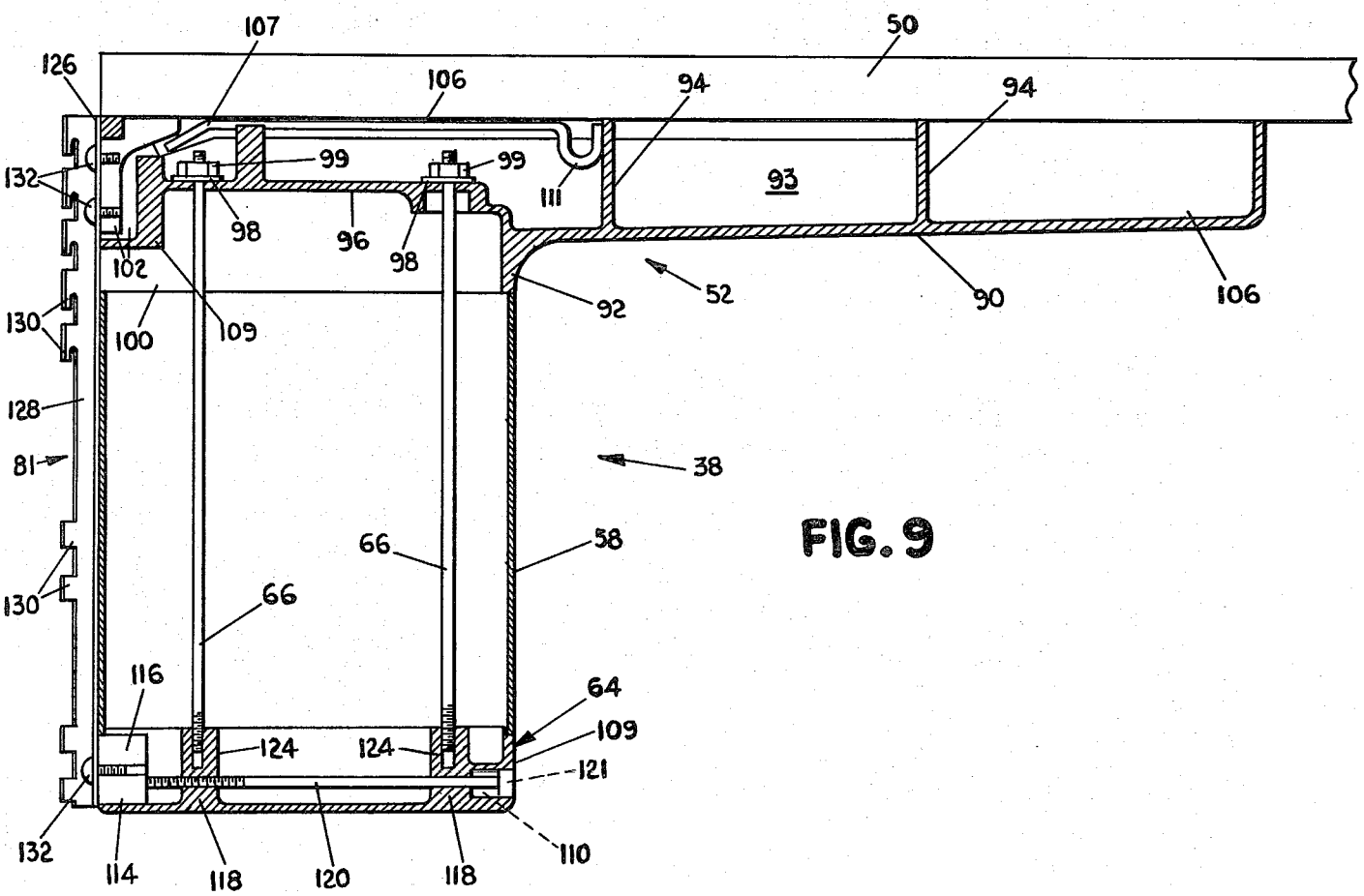
FIG. 9 is a cross-sectional view of a support arm and leg tube assembly in accordance with the invention taken along line 9—9 of FIG. 10.

FIG. 5 shows an alternate form of a hanging surface 34 wherein a hanger rail 72 is releasably secured to a wall-supported rail 76 in order to releasably mount the hanging surface 34 to a vertical wall 16. The work surface 50 is supported by a support assembly 38 comprising support arms 52, legs 58 and end caps 64 all connected together by means of the tie rod 66. Again, a stretcher rail 61 is mounted between the tubes 58 to provide for mounting of storage components. The rail 72 is secured to the support assemblies 38 by means of screws 73. The screws 73 are threaded into the rear of the support assembly 38 in the same manner that the clips 81 are secured to the support assembly 38 which is shown in FIG. 9 with the screws 73 passing through apertures in the rail 72. The top portion of the rail 72 includes a flange 74 which is received on a complementary flange on the wall-supported rail 76. The bottom of the hanger rail 72 includes a channel 78 which abuts the wall and maintains the hanging surface 34 in a horizontal orientation.

Figure 6:
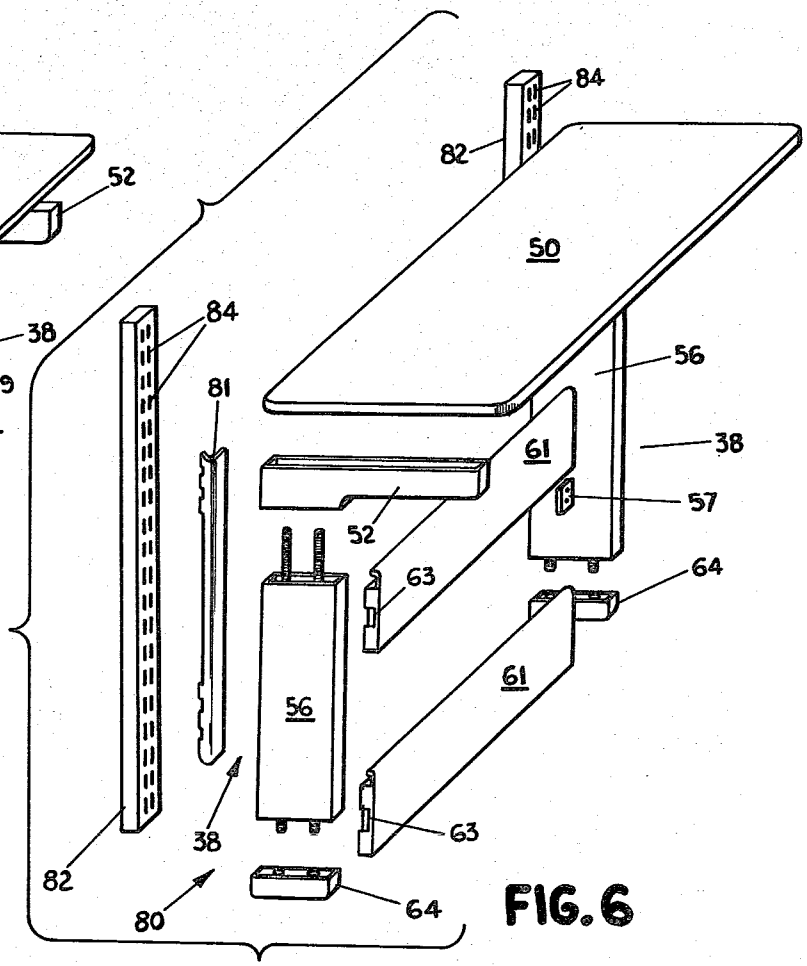
FIG. 6 is an exploded view of a work surface mounted to a vertical support in accordance with the invention.

FIG. 6 shows another form of a hanging surface similar to that shown in FIG. 4, the distinction lying in the use of one elongate tube 56 as opposed to two shorter tubes 58 to mount the stretcher rails 61.

Figure 7:
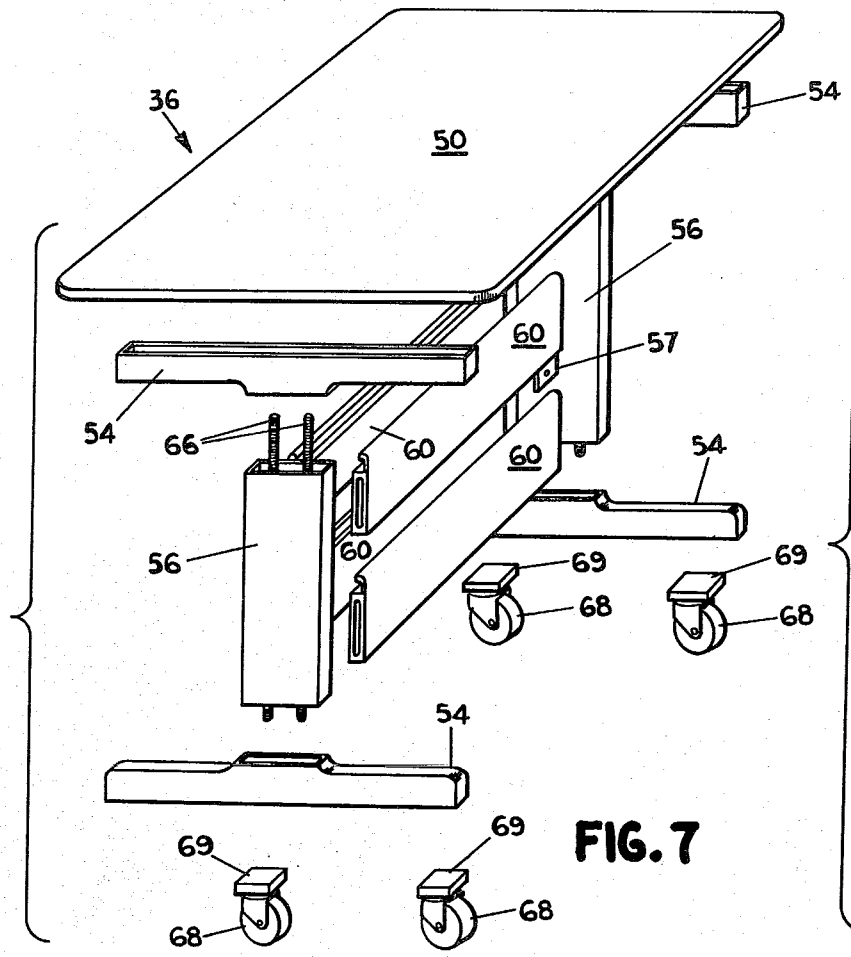
FIG. 7 is an exploded view of another table in accordance with the invention.

FIG. 7 shows another form of a freestanding work table having a large work surface 50 supported on double-width support arms 54, leg tubes 56 and a base constructed of inverted support arms 54. The table 36 can be provided with gliders 68 or casters 70, as described above, to allow for movement of the table 36. Extending between the leg tubes 56 are stretcher rails 60 which allow the table 36 to support the various hanging storage components. The rails 60 are mounted in the manner described above.

Figure 8:
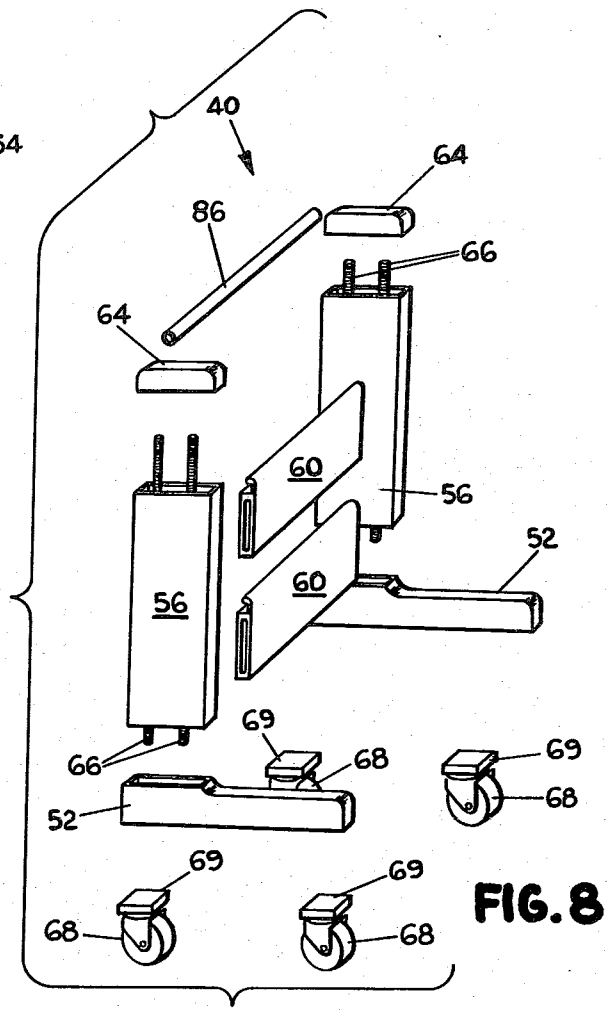
FIG. 8 is an exploded view of a mobile cart in accordance with the invention.

FIG. 8 illustrates a cart 40 constructed of the components used to make up the hanging surfaces 34 and free-standing tables 36. The cart 40 includes side portions constructed of leg tubes 56 which mount inverted support arms 52 so as to form a base for the cart. It thus can be seen that the sides of the carts 40 are formed by inverted support assemblies 38. Elongate tie rods 66 connect the leg tubes 56 to the inverted support arms 52 as well as to end caps 64 which provide a finished appearance to the cart 40. A handle 86 is mounted to the rear portion of the cart between the end caps 64. The cart 40 is provided with casters 68 mounted to caster pads 69 which allow the cart to be moved about the room. Mounted between the leg tubes 56 are two stretcher rails 60. The stretcher rails, which are secured in the manner described above with reference to FIG. 3, allows the cart 40 to hold storage units for movement about the laboratory or provide a temporary storage device.

Figure 10:
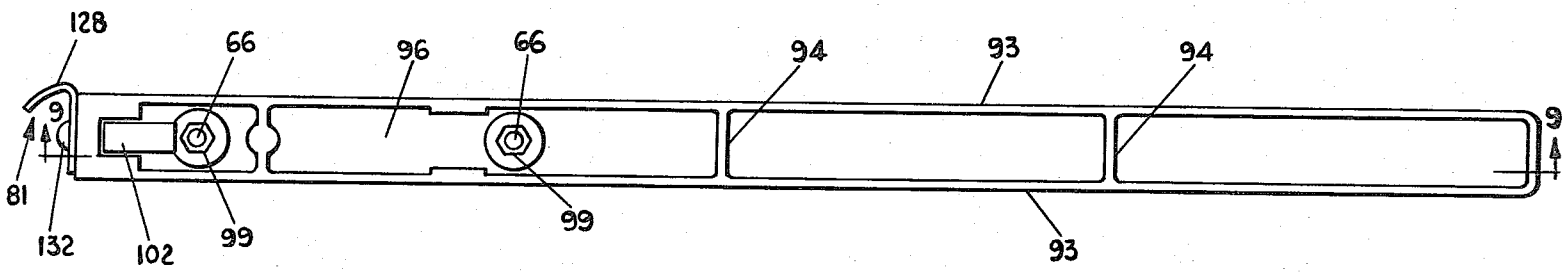
FIG. 10 is a top view of the bracket arm in accordance with the invention.

FIGS. 9 and 10 show in detail the support assembly 38. The hanging surface 34 includes a work surface 50 mounted to the support assemblies 38 comprising support arms 52, leg tubes 58 and end caps 64, all of which are connected together by means of tie rods 66, as will be described in more detail below.

The support arm 52 has an extending arm portion 90 and a base portion 92. The support arm 52 is die cast and has two generally parallel walls 93 joined together by integrally-formed webs 94 which extend between the walls 93. An interior flange 96 also extends between the walls 93 of the arm 52 and perpendicular thereto. The flange 96 is provided with through-holes 98 which receive ends of the tie rod 66. Nuts 99 secure the rods 66 in place. The rear portion of the arm 52 includes a recess 100 which receives a clip block 102 which facilitates mounting of the hanger clip 81 to the support assembly 38 by means of screws 132. The clip block 102 also allows for adjustment of the angular orientation of the work surface 50 as will be described below. The clip block 102 is maintained within the recess by a pivot point 97 integrally formed with the die cast arm 52. The underside of the work surface 50 is provided with a mounting clip 106 which is received within the top portion of the bracket 52. Rear portion 107 of mounting clip 106 is angled so as to fit between the clip block 102 and an interior flange 109 within the support arm 52. The opposite end 111 of the mounting clip 106 has a curved configuration so as to abut one of the webs 94 to prevent sliding of the work surface 50 on the support assembly 38. The work surface 50 is mounted to the arm 52 by sliding the angled portion 107 of the mounting clip 106 into place and then allowing the work surface 50 to drop down onto the arm 90 of the bracket so that the curved portion 108 nests next to web 94.

The end cap 64, which is a die-cast part, includes a front wall 109 having a recess 110 and webs 118 which extend between side walls of the end cap 64. A rod 120 which allows for angular adjustment of the work surface 50 supported on the support assemblies 38 extends through the depth of the end cap and passes through bores 119 in the webs 118. The rod 120 includes a head 121 received in recess 110 in the front wall 109 of the end cap 64. The head 121 of the rod 120 receives an Allen wrench. The rear portion of the end cap 64 is open so as to mount block 114. The block 114 includes an aperture 116 which receives a screw 132 for securing the clip 81 to the support assembly 38. The end cap 64 is secured in place by the tie rods 66. The ends of the tie rods 66 are received in threaded bores 124 in the webs 118.

The hanger clip has a generally V-shaped configuration and has a front web 126 which is seated against the back of the support assembly 38 and secured thereto by means of screws 132 which are threaded into clip block 102 and block 114. Extending from the front web 126 at an angle thereto is a rear web 128 which is provided with a plurality of tabs 130 received in the hanger slots 84 in vertical stiles 82 attached to a frame module 22 or a wall 16.

The clip block 102, threaded rod 120 and block 114 at the bottom portion of the bracket 36 allow for angular adjustment of the work surface 50 to compensate for load deflection. In order to level the surface, an Allen wrench is inserted into the head 121 of rod 120. The wrench is used to rotate the rod 120 which bears against the block 114. Rotation of the rod 120 causes the rod 120 to push off of the block 114 so that the work surface 50 pivots about its top portion, with the clip block 102 rotating about the pivot point 97. In this way, the work surface 50 is levelled to compensate for loading.

As can be seen, the extending arm portion 93 of the support arm 52 includes opposing spaced-apart side walls 93 which are interconnected by webs 94. The support arm 52 has a generally vertical base portion 92 disposed at right angles to the generally horizontal arm portion 93 which extends therefrom and to which the work surface 50 is attached. The leg tubes 52 are secured to the base portion 92 of the support arm 52 so that the entire support assembly 38 has a generally 90° configuration. The width of the leg tube 52 and the base portion 92 of the support arm 52 is approximately $\frac{1}{4}$–$\frac{1}{3}$ of the width of the extending arm portion 93. This presents a relatively large base portion which gives the support assembly 38 a good load capacity and would resist twisting and deflection of the support assembly 38. Further, different-sized support assemblies 38 are assembled from a plurality of common parts so that a single support arm 52 can be used with leg tubes of differing lengths depending upon whether a hanging surface 34, table 36 or cart 40 is to be constructed.

It can be seen that all of the work surfaces used in the laboratory system are formed from a plurality of common parts. This provides for great flexibility in the system and reduces costs in constructing such a system. In this way, tooling requirements to manufacture the components of this system are reduced. Further, changes in the system are easily accomplished by taking the existing components and restructuring them into the desired surfaces, tables and carts. It thus can be seen that the above-described elements allow for the construction of a laboratory system which is readily changeable into the desired configuration in a cost efficient manner. Further, the use of the common components presents a pleasing aesthetic appearance.

The mounting of stretcher rails between the brackets provides for installation of storage components which are not hung from the underside of the work surface so as to avoid decreasing the load capacity of the work surface. Instead, the stretcher rail allows the weight of the storage components to be supported by the brackets and the vertical walls and frames of the system. Finally, the angular adjustment feature allows for the levelling of the work surface in response to load deflection caused by equipment stored on the tops of the hanging surfaces.

The foregoing and description of drawings are merely illustrative of the invention and are not intended to limit the invention to the above-described embodiments. Variations and changes which may be obvious to one skilled in the art may be made without departing from the scope and spirit of the invention as defined in the appended claims.

The embodiments of the invention in which an exclusive property or privilege is claimed are defined as follows:

1. A modular laboratory furniture system for arrangement in a room comprising:

freestanding tubular frame modules and freestanding tables, all of which are selectively arranged about said room in a preplanned configuration;

mobile carts movable about said room between said frame modules and freestanding tables;

each of said frame modules and tables mounting a horizontal work surface;

pairs of spaced-apart common support means for mounting said work surfaces to said frame modules and tables and forming side of said mobile carts;

each of said common support means including a hollow vertical leg of rectangular cross-section;

a bracket member having an extension arm for mounting to an underside of said work surface or for providing a bottom support and a base portion for mounting to said vertical leg;

means mounting one portion of said leg to said base portion of the bracket member;

said base portion mating with said cross-sectional configuration of said vertical leg;

rails each of which is detachably secured to a pair of the hollow vertical legs of a pair of spaced-apart support means;

means mounting said work surface to said extension arms of certain of said bracket members;

storage components releasably supported on said frame modules, tables and carts;

at least one of said storage components secured to at least one said rail;

wherein said common support means for mounting said work surfaces to said frame modules and tables provides for construction of said system using a minimum of parts and provides for versatility in making changes to said system.

2. The system of claim 1 wherein said bracket member is a unitary member having two parallel side walls joined by perpendicular webs integrally formed with said side walls.

3. The system of claim 1 wherein said means mounting said leg to said bracket member includes rods fastened between said bracket member and a lower portion of said vertical leg.

4. The system of claim 3 wherein said lower portion of said leg is a separate cap member.

5. The system of claim 1 wherein said rail is a hollow extruded member having a generally rectangular cross-section.

6. The system of claim 5 wherein said rail includes a lip for mating with an attachment member on said storage components.

7. The system of claim 1 further including hanger means on said frame modules for releasably supporting said support means.

8. The system of claim 7 further including hanger clips fastened to said bracket members and releasably received on said hanger means.

9. The system of claim 1 including levelling means for adjusting the horizontal orientation of the work surfaces.

10. The system of claim 9 wherein said levelling means includes means mounting an upper portion of said support means to a vertical support for pivoting movement about a horizontal axis and means for pivoting said support means about said horizontal axis.

11. The system of claim 10 wherein said means for pivoting includes a block member secured stationary relative to said support means and a rod threadedly received in said support member having an end portion bearing against said block member wherein rotation of said rod causes said support means to angularly displace relative to said block member and pivot about said horizontal axis.

12. The system of claim 1 wherein the freestanding tables include base means for supporting said table on the floor of the room.

13. The system of claim 12 wherein said base means comprises another of said bracket member having said extension arm thereof positioned adjacent the floor of the room.

14. The system of claim 1 wherein the bracket members of each of said mobile carts are mounted to the bottom portions of said vertical legs so as to provide a bottom support, cap members are mounted to the top portions of each of said vertical legs, and said means mounting said leg to said bracket member also mounts said cap members to said legs.

15. The system of claim 14 wherein said mobile carts include wheel means mounted to bracket member for rolling said carts about said room.

16. An assembly for supporting a work surface comprising:

a hollow vertical leg having an elongated rectangular horizontal cross-section which is uniform in dimensions throughout the length thereof;

a first hollow bracket member including an extension arm disposed generally perpendicular to the longitudinal axis of said leg for mounting to an underside of a work surface and a base portion collinearly arranged with said leg for mounting to said vertical leg, a bottom surface of said base being congruent with an upper edge of said hollow vertical leg;

a second hollow bracket having an upper surface portion of a shape congruent with said rectangular cross-section of said hollow vertical leg, said upper surface portion being in contact with a lower edge of said hollow leg; and means extending from said first bracket to said second bracket through said hollow leg for securing said vertical leg to said first and second bracket members.

17. The bracket assembly of claim 16 wherein said extension arm is a unitary member including spaced-apart parallel side walls joined by webs integrally formed with said side walls.

18. The bracket assembly of claim 16 wherein said means securing said leg to said bracket members includes rods fastened to said first and second brackets.

* * * * *